US008550005B1

(12) United States Patent
Olden et al.

(10) Patent No.: US 8,550,005 B1
(45) Date of Patent: Oct. 8, 2013

(54) NON-LETHAL DELIVERY CANISTER, THREAT MITIGATION SYSTEM, AND METHODS FOR MITIGATING BOMBER AND PERPETRATOR THREATS

(75) Inventors: Thomas A. Olden, Tucson, AZ (US); Oscar Kenneth Ohanian, Tucson, AZ (US); Damian C. Athey, Tucson, AZ (US); Robert P. Johnson, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 244 days.

(21) Appl. No.: 13/204,246

(22) Filed: Aug. 5, 2011

Related U.S. Application Data

(60) Provisional application No. 61/419,953, filed on Dec. 6, 2010.

(51) Int. Cl.
*F42B 12/36* (2006.01)

(52) U.S. Cl.
USPC ..... 102/502

(58) Field of Classification Search
USPC ..... 102/502, 504
See application file for complete search history.

(56) References Cited

U.S. PATENT DOCUMENTS 3,710,720 A * 1/1973 Mawhinney ..... 102/391
5,155,296 A 10/1992 Michaluk
5,898,125 A 4/1999 Mangolds et al.
6,904,838 B1 6/2005 Dindl
7,441,511 B2 10/2008 Farinella et al.

FOREIGN PATENT DOCUMENTS

WO WO-2012078215 A1 6/2012

OTHER PUBLICATIONS

"International Application Serial No. PCT/US2044/046784, International Search Report mailed Jan. 6, 2012", 2 pgs.
"International Application Serial No. PCT/US2044/046784, Written Opinion mailed Jan. 6, 2012", 5 pgs.
"International Application Serial No. PCT/US2011/046784, International Preliminary Report on Patentability mailed Aug. 15, 2013", 24 pgs.

* cited by examiner

*Primary Examiner* — Michael Carone
*Assistant Examiner* — Reginald Tillman, Jr.
(74) *Attorney, Agent, or Firm* — Schwegman Lundberg & Woessner, P.A.

(57) ABSTRACT

Embodiments of a non-lethal delivery canister, a bomber/perpetrator threat-mitigation system, and methods of mitigating bomber and perpetrator threats are generally described herein. In some embodiments, the non-lethal delivery canister may include a shell, a plastic-fabric liner within the shell to hold the shell together, and an entrapment device within the liner. The shell may be configured to break away and disintegrate after launch and prior to target impact to help ensure non-lethality. In some embodiments, the delivery canister may include an exhaust-gas generator (EGG) to generate a high-pressure gas, and an exhaust-gas director within the liner to direct the high-pressure gas generated by the EGG into the liner cause the entrapment device to expel.

20 Claims, 1 Drawing Sheet

NON-LETHAL DELIVERY CANISTER, THREAT MITIGATION SYSTEM, AND METHODS FOR MITIGATING BOMBER AND PERPETRATOR THREATS

PRIORITY CLAIM

This patent application claims priority under 35 U.S.C. 119 to U.S. Provisional Patent Application Ser. No. 61/419,953, filed Dec. 6, 2010.

GOVERNMENT RIGHTS

This invention was not made with United States Government support. The United States Government does not have certain rights in this invention.

TECHNICAL FIELD

Some embodiments pertain to bomber threat mitigation. Some embodiments pertain to perpetrator threat mitigation.

BACKGROUND

One issue with mitigating bomber and perpetrator threats is reducing the risks of injury to bystanders as well reducing risks to a perceived perpetrator. Conventional bomber mitigation techniques use lethal force, however this increases the risk of injury to innocent bystanders as well as the perpetrator.

Thus, there are general needs for non-lethal threat-mitigation systems and methods for mitigating bomber and perpetrator threats.

SUMMARY

In some embodiments, a non-lethal delivery canister is provided. The non-lethal delivery canister may comprise a shell, a plastic-fabric liner within the shell to hold the shell together, an entrapment device within the liner, an exhaust-gas generator (EGG) to generate a high-pressure gas, and an exhaust-gas director within the liner to direct the high-pressure gas generated by the EGG. The shell may be configured to break away and disintegrate after launch and prior to target impact to help insure non-lethality of the perpetrator as well as innocent bystanders.

In some embodiments, a method of mitigating a threat is provided. In these embodiments, the method may include launching a non-lethal delivery canister toward a perceived perpetrator target, causing a shell of the delivery canister to break away and disintegrate prior to reaching the target, deploying an entrapment device prior to reaching the target to either wrap around the target or entrap packed metal projectiles (PMPs). The entrapment device may be either a perpetrator-style entrapment device configured to at least partially wrap around a perpetrator to inhibit movement of the perpetrator, or a bomber-style entrapment device configured to retain packed metal projectiles (PMPs) of a bomb.

In some embodiments, a threat-mitigation system is provided. In these embodiments, the threat-mitigation system may comprise a delivery canister and a launcher configured to launch the delivery canister to cause the entrapment device to either wrap around a target or entrap packed metal projectiles (PMPs).

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

A non-lethal delivery canister and a bomber threat-mitigation system are disclosed herein. The non-lethal delivery canister may be able to eject either a perpetrator-style or a terrorist/bomber-style entrapment device at a standoff distance to help ensure complete entrapment device deployment. The embodiments of the delivery canister discussed in more detail below may be able to help ensure that the elements of the delivery canister, other than the entrapment device itself, do not impact the "threat" (i.e., the perpetrator or the perceived perpetrator). Embodiments may also help ensure that elements of the delivery canister do not impact or injure innocent by-standers. The delivery canister may be configured to withstand a launch event of the bomber/perpetrator threat mitigation system, and may be able to withstand the "rifling" translation (i.e., spinning) during a ballistic trajectory for engagement range. In some embodiments, the engagement range may range from as little as five meters or less to as great as one-hundred meters or more.

Embodiments of the delivery canister disclosed herein may allow the entrapment device to be delivered to the bomber without impeding the functionality of the entrapment device. Furthermore, some embodiments of the delivery canister may assist the opening and deployment of the entrapment device to allow a maximum surface area attach to a target. In these embodiments, the various element of the delivery canister may drop away and/or disintegrate after deployment to help prevent injury to persons in the area of mitigation.

Figure 1:
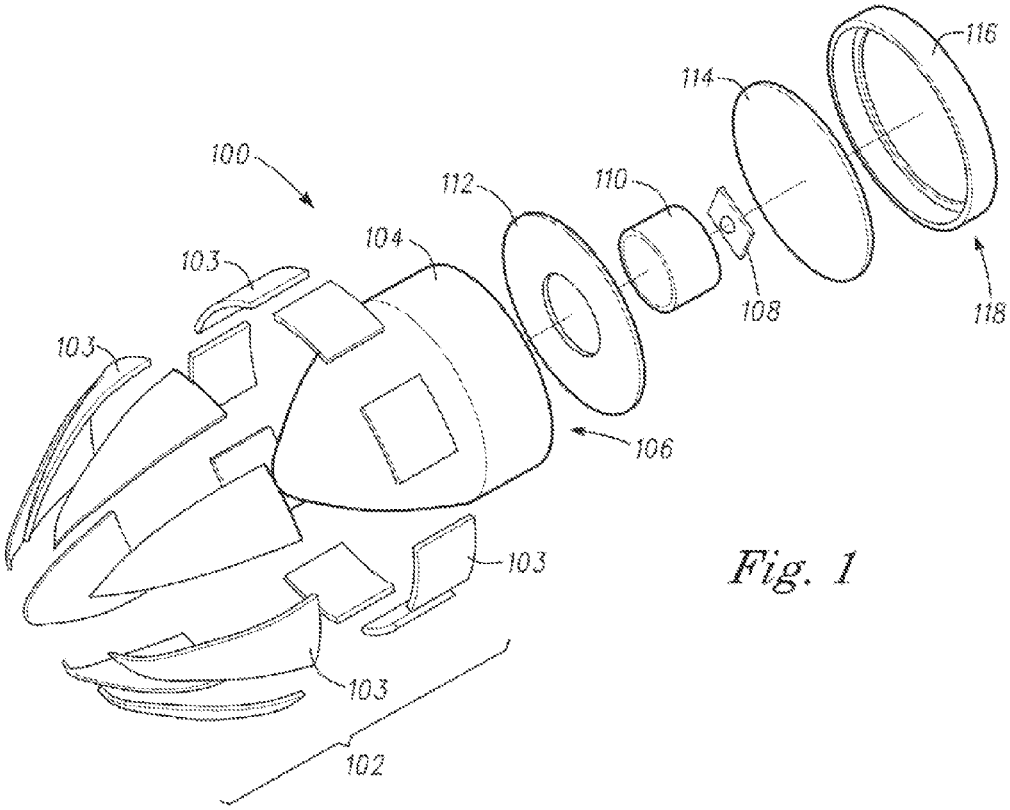
FIG. 1 is an exploded-view of a non-lethal delivery canister in accordance with some embodiments.

FIG. 1 is an exploded view of a non-lethal delivery canister 100 in accordance with some embodiments. The non-lethal delivery canister 100 may include a shell 102 and a plastic-fabric liner 104 within the shell 102 to hold the shell 102 together. The non-lethal delivery canister 100 may also include an entrapment device 106 within the liner 104, an exhaust-gas generator (EGG) 108 to generate a high-pressure gas, and an exhaust-gas director 110 to direct the high-pressure gas generated by the EGG 108.

In some embodiments, the shell 102 is configured to break away and disintegrate after launch and prior to target impact. In this way, a non-lethal delivery of the delivery canister 100 can be provided.

In some embodiments, the shell 102 may be a sectioned shell comprising a plurality of sections 103. In some embodiments, the shell 102 may be configured to break apart into the plurality of sections 103. In some embodiments, the shell 102 may include Ni-Chrome (NiCr) wire configured to burn and break the shell 102 apart into the sections 103.

In some hard-shell embodiments, the shell 102 may comprise a hard or rigid material such as para-aramid synthetic fiber material (e.g., Kevlar), cork or fiberglass, although the scope of the invention is not limited in this respect. In some soft-shell embodiments, the shell may be comprised a softer or less rigid material, such as nylon, polyethylene or polypropylene. In some embodiments, a polyester fiber based material may be used.

In some embodiments, the delivery canister 100 may also include a controller that is programmed to cause the EGG 108 to generate the high-pressure gas at a programmed time after the launch and/or based on predetermined distance from the target. The controller may also be configured to cause the Ni-Chrome wire to burn at a predetermined time after launch or distance from the target.

The exhaust-gas director 110 may be positioned to direct the high-pressure gas generated by the EGG 108 into the liner 104 (i.e., forward toward the nose) to cause the entrapment device 106 to expel (i.e., deploy) toward the target. In some embodiments, the exhaust-gas director 110 may operate as a pressure vessel.

The entrapment device 106 may be either perpetrator-style or a terrorist/bomber-style entrapment device that is configured to be deployed at a standoff distance. When the entrapment device 106 is a perpetrator-style entrapment device, it may be configured to at least partially (or even fully) wrap around a perpetrator to inhibit movement of the perpetrator. When the entrapment device 106 is a terrorist/bomber-style entrapment device, it may be configured to retain packed metal projectiles (PMPs) of a bomb, which may be located on a perpetrators person. The entrapment device 106 may be configured to create a barrier to slow and/or attenuate a shock wave of an explosion.

In some embodiments, the target may be a human (e.g., a bomber or perpetrator) or a bomb, and deployment of the entrapment device 106 may provide a non-lethal way of mitigating a perpetrator or bomber threat without injuring bystanders, and possibly reducing injury to the perpetrator.

In some embodiments, the entrapment device 106 may be packed tightly within the liner 104. The entrapment device 106 may be a shroud and the delivery canister 100 may be a projectile. In some embodiments, the high-pressure gas generated by the EGG 108 may cause the entrapment device 106 to spin. The entrapment device 106 may be substantially circular in shape and may have a diameter of up to sixty inches or greater. The entrapment device 106 may comprise one or more layers of a fabric type material, although this is not a requirement.

The delivery canister 100 may be gun-launched at a calculated azimuth and elevation angle. The controller of the delivery canister 100 may be programmed with distance and timing information for deployment of the entrapment device 106.

The delivery canister 100 may also include a first circular plate 112 with a hole to retain the exhaust-gas director 110 at a predetermined location within the delivery canister 100. A second circular plate 114 may be provided at an aft end 118 of the delivery canister 100 to operate as a bulkhead providing a solid backing for launch of the delivery canister 100. The delivery canister 100 may include a ring 116 for coupling with the shell 102 and configured to ride within a launcher tube. The second circular plate 114 may be provided within the ring 116 to retain the liner 104, the entrapment device 106, the EGG 108, the exhaust-gas director 110 and the first circular plate 112 within the delivery canister 100. In some embodiments, the ring 116 may be a Polyoxymethylene plastic material (e.g., Delrin), and the circular plates 112 and 114 may comprise a carbon fiber material, a para-aramid synthetic fiber material (e.g., Kevlar), or a fiberglass material. In some embodiments, the exhaust-gas director 110 may have a ridge to hold the circular first plate 112.

Figure 2:
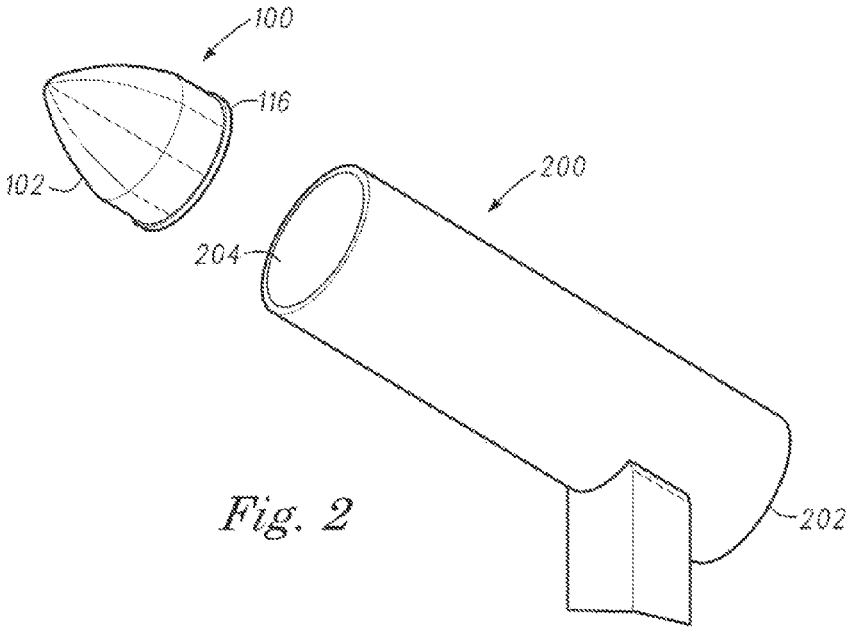
FIG. 2 is a threat mitigation system in accordance with some embodiments.

FIG. 2 is a threat mitigation system 200 in accordance with some embodiments. The bomber/perpetrator threat-mitigation system 200 includes a delivery canister, such as delivery canister 100 (FIG. 1), and a launcher 202 configured to launch the delivery canister 100 toward a target. The launcher 202 includes a launcher tube 204, which may have rifling therein to induce a spin on the delivery canister 100 for spin stabilization. The launcher 202 may be configured to provide information to the controller of the delivery canister 100 prior to launch to indicate when to cause the shell to disintegrate and when to deploy the entrapment device 106. In these embodiments, the shell 102 may be instructed to be disintegrated and entrapment device 106 may be deployed based on distance to the target, or based on time after launch. To help insure non-lethality, the shell 102 may be instructed to disintegrate and entrapment device 106 may be deployed based on both distance to the target and time after launch to help ensure non-lethality.

In some embodiments, a method of mitigating a bomber or a perpetrator threat is provided. The method may include launching a non-lethal delivery canister, such as delivery canister 100 (FIG. 1), toward a perceived perpetrator target, causing a shell of the delivery canister to break away and disintegrate prior to reaching the target. An entrapment device may be deployed prior to reaching the target to either wrap around the target or entrap packed metal projectiles. In these embodiments, causing the shell of the delivery canister to break away and disintegrate prior to reaching the target helps ensure non-lethality.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A non-lethal delivery canister comprising:

a shell;

a plastic-fabric liner within the shell to hold the shell together;

an entrapment device within the liner;

an exhaust-gas generator (EGG) to generate a high-pressure gas; and an exhaust-gas director within the liner to direct the high-pressure gas generated by the EGG to cause the entrapment device to expel, wherein the entrapment device is interposed between the exhaust-gas director and the liner.

2. The delivery canister of claim 1 wherein the shell is configured to break away and disintegrate after launch and prior to target impact.

3. The delivery canister of claim 2 wherein the shell is a sectioned shell comprising a plurality of sections.

4. The delivery canister of claim 3 wherein the shell includes Ni-Chrome (NiCr) wire configured to burn and break the shell apart into the plurality of sections.

5. The delivery canister of claim 2 further comprising a controller that is programmed to cause the EGG to generate the high-pressure gas at either a programmed time after the launch or based on a predetermined distance from target.

6. The delivery canister of claim 5 wherein the exhaust-gas director is positioned to direct the high-pressure gas generated by the EGG into the liner.

7. The delivery canister of claim 6 wherein the entrapment device is a perpetrator-style entrapment device configured to at least partially wrap around a perpetrator to inhibit movement of the perpetrator.

8. The delivery canister of claim 6 wherein the entrapment device is a terrorist/bomber-style entrapment device configured to retain packed metal projectiles (PMPs) of a bomb.

9. The delivery canister of claim 6 wherein the entrapment device is packed tightly within the liner prior to the launch.

10. The delivery canister of claim 6 further comprising a first circular plate with a hole to retain the exhaust-gas director at a predetermined location within the delivery canister;

a second circular plate provided at an aft end of the delivery canister to operate as a bulkhead providing a solid backing for the launch of the delivery canister; and a ring for coupling with the shell and configured to ride within a launcher tube.

11. The delivery canister of claim 10 wherein the second circular plate is configured to be provided within the ring to retain the liner, the entrapment device, the EGG, the exhaust-gas director and the first circular plate within the delivery canister.

12. A threat-mitigation system comprising:

a non-lethal delivery canister; and a launcher configured to launch the delivery canister to cause the entrapment device to either wrap around a target or entrap packed metal projectiles (PMPs), wherein the delivery canister comprises:

a shell;

a plastic-fabric liner within the shell to hold the shell together;

an entrapment device within the liner;

an exhaust-gas generator (EGG) to generate a high-pressure gas; and an exhaust-gas director within the liner to direct the high-pressure gas generated by the EGG into the liner cause the entrapment device to expel, wherein the entrapment device is interposed between the exhaust-gas director and the liner.

13. The threat mitigation system of claim 12 wherein the shell is a sectioned shell comprising a plurality of sections and is configured to break away and disintegrate after launch and prior to target impact.

14. The threat mitigation system of claim 13 wherein the delivery canister further comprises a first circular plate with a hole to retain the exhaust-gas director at a predetermined location within the delivery canister;

a second circular plate provided at an aft end of the delivery canister to operate as a bulkhead providing a solid backing for the launch of the delivery canister; and a ring for coupling with the shell and configured to ride within a launcher tube.

15. The threat mitigation system of claim 14 wherein the launcher is configured to induce a spin on the delivery canister during launch for spin stabilization.

16. A method of mitigating a threat comprising:

launching a non-lethal delivery canister toward a perceived perpetrator target, the non-lethal delivery canister including:

a shell;

a plastic-fabric liner within the shell to hold the shell together; and an entrapment device within the liner;

causing the shell of the delivery canister to break away and disintegrate prior to reaching the target by way of a high-pressure gas directed through an exhaust-gas director, the entrapment device interposed between the liner and the exhaust-gas director; and deploying the entrapment device prior to reaching the target to either wrap around the target or entrap packed metal projectiles (PMPs).

17. The method of claim 16 wherein the entrapment device is either a perpetrator-style entrapment device configured to at least partially wrap around a perpetrator to inhibit movement of the perpetrator, or a bomber-style entrapment device configured to retain packed metal projectiles (PMPs) of a bomb.

18. The method of claim 17 wherein the delivery canister comprises an exhaust-gas generator (EGG) coincident with the exhaust-gas director, and wherein the method further comprises:

generating a high-pressure gas with the EGG; and directing the high-pressure gas into the liner through the exhaust-gas directors causes the entrapment device to expel after launch of the delivery canister.

19. The method of claim 18 wherein the shell is a sectioned shell comprising a plurality of sections and is configured to break away and disintegrate after launch and prior to target impact.

20. The method of claim 19 wherein the delivery canister further comprises a first circular plate with a hole to retain the exhaust-gas director at a predetermined location within the delivery canister;

a second circular plate provided at an aft end of the delivery canister to operate as a bulkhead providing a solid backing for the launch of the delivery canister; and a ring for coupling with the shell and configured to ride within a launcher tube.

* * * * *